US007128248B2

(12) United States Patent
Frassinelli

(10) Patent No.: US 7,128,248 B2
(45) Date of Patent: Oct. 31, 2006

(54) COAT HANGER STRUCTURE WITH HOOK HAVING A VARIABLE-HEIGHT

(75) Inventor: Ernesto Frassinelli, Vittorio Veneto (IT)

(73) Assignee: Bencom S.r.l. (IT)

( * ) Notice: Subject to any disclaimer, the term of this patent is extended or adjusted under 35 U.S.C. 154(b) by 396 days.

(21) Appl. No.: 10/730,895

(22) Filed: Dec. 10, 2003

(65) Prior Publication Data

US 2004/0112929 A1 Jun. 17, 2004

(30) Foreign Application Priority Data

Dec. 10, 2002 (IT) ..... BG20020014 U

(51) Int. Cl.
*A41D 27/22* (2006.01)

(52) U.S. Cl. ..... 223/85; 223/DIG. 4

(58) Field of Classification Search ..... 223/85, 223/88, 89, 91, 92, DIG. 4; 211/113
See application file for complete search history.

(56) References Cited

U.S. PATENT DOCUMENTS 2,151,621 A * 3/1939 Silverman ..... 223/88
2,645,357 A * 7/1953 Taylor et al. ..... 211/117
3,227,334 A * 1/1966 Samuelsson ..... 223/85
3,679,100 A * 7/1972 Brorson et al. ..... 223/88
3,856,190 A * 12/1974 Mole et al. ..... 223/94
4,669,642 A 6/1987 Nicholas
5,052,599 A * 10/1991 Platti ..... 223/89
5,971,237 A * 10/1999 Timbrook ..... 223/85

FOREIGN PATENT DOCUMENTS

GB 619455 3/1949
GB 2 377 631 1/2003
JP 10272047 10/1998

OTHER PUBLICATIONS

European Search Report dated Feb. 26, 2004; No. EP 03 07 8822; 2 pages.

* cited by examiner

*Primary Examiner*—Gary L. Welch
(74) *Attorney, Agent, or Firm*—Connolly Bove Lodge & Hutz LLP

(57) ABSTRACT

Clothes hanger structure comprising two arms, designed to provide a support for a garment, and a hook provided with a stem fixed at the center line of the hanger. The stem is provided with a portion that can engage to a variable depth in a seat provided at the centre line of the structure, thus permitting at least two fixing positions, one extended and one retracted. This structure permits use of the clothes hanger both during manufacture of the garment and in the domestic environment.

16 Claims, 4 Drawing Sheets

COAT HANGER STRUCTURE WITH HOOK HAVING A VARIABLE-HEIGHT

BACKGROUND

The present invention concerns a clothes hanger structure with variable-height hook.

In the mass production of clothing, particularly sleeve units such as jackets and similar, the garments are moved along production and storage lines hanging on clothes hangers. For this purpose, the clothes hangers must have dimensional characteristics compatible with the production lines. Said dimensional characteristics can be different from those of the clothes hangers used in commercial distribution units or in the domestic environment, chiefly as regards the hook or upper element of the clothes hanger.

In particular, the clothes hangers used in industrial clothing production require a longer hook. Between the clothes hanger hanging point and the base of the hook, corresponding to the area where the garment rests, there must be a sufficient distance to permit accommodation in the production line for performance of the necessary work processes and movement along the conveying and storage lines. Said distance is usually greater than the distance between the hanging point and the base of the hook typical of clothes hangers for commercial or domestic use. In this case, the requirements as regards the height of the hook are the opposite as the end user does not want clothes hangers with hooks that are too long which may not be suited to the restricted space of domestic wardrobes.

For the clothing industry this means that clothes hangers with long suspension hooks have to be used during the industrial production and storage phases and then replaced with clothes hangers with short hooks before shipment of the garments to the distribution units and then to the end user. Obviously this constitutes an additional cost for the clothing industry.

The present invention aims to eliminate the cost associated with replacing clothes hangers between the clothing production and storage phase and the distribution phase, providing a clothes hanger structure which, in one single product, can meet the needs of both the clothing industry and those of commercial distribution and the end user.

This aim is achieved by means of a clothes hanger structure comprising two arms designed to provide a support for a garment and hanging means fixed to said arms, characterised in that said hanging means comprises a stem fixed in a corresponding seat of said structure, said seat being provided with means of engagement of at least a portion of said stem, thus permitting at least two fixing positions, one extended and one retracted.

BRIEF DESCRIPTION OF THE DRAWINGS

The invention will now be described with reference to the attached drawings, provided as an illustrative non-restrictive example, in which.

DETAILED DESCRIPTION

Figure 1:
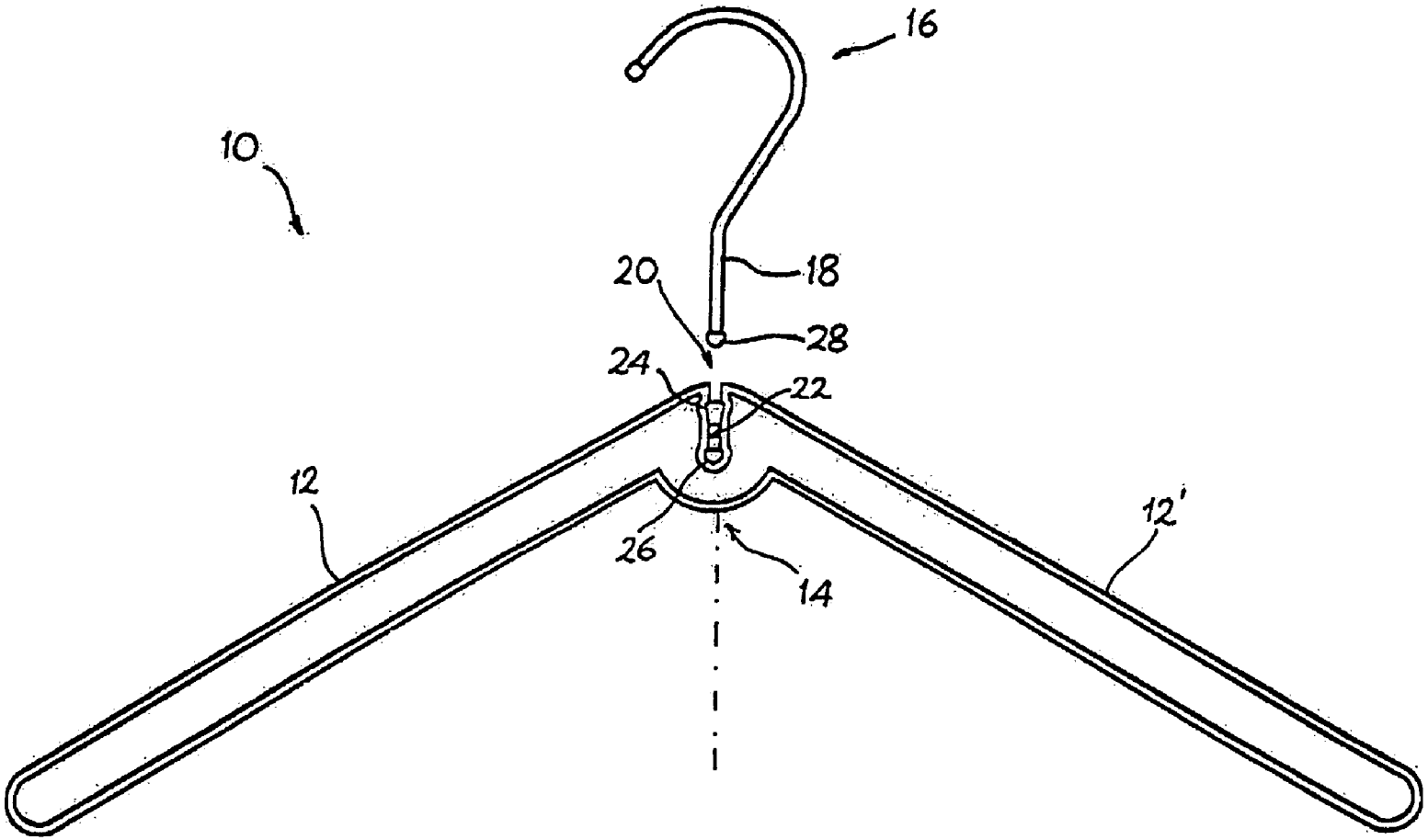
FIG. 1 is an exploded view of a half-shell of a clothes hanger structure according to a first embodiment of the invention.

With reference to FIG. 1, a half-shell of the clothes hanger structure 10 according to a first embodiment of the invention comprises two arms 12, 12' that extend symmetrically from a centre line 14. A hanging means consisting of a hook 16 provided with a stem 18, shown in a form not assembled to the rest of the structure, is designed to be inserted and fixed to the structure 10 in a corresponding seat constituted by a vertical dead hole 20 provided at the centre line 14. At least the wall 22 of the dead hole 20 is made of a material with a certain flexibility, for example plastic material. The wall 22 is provided with toroidal cavities 24, 26, one upper and one lower, that constitute the housings for an expansion 28 provided in the stem 18 of the hook 16. The hole 20 has a diameter slightly smaller that that of the expansion 28 so that the stem 18 of the hook and the related expansion 28 can be inserted and can slide in the hole 20 when pressed down.

Figure 2:
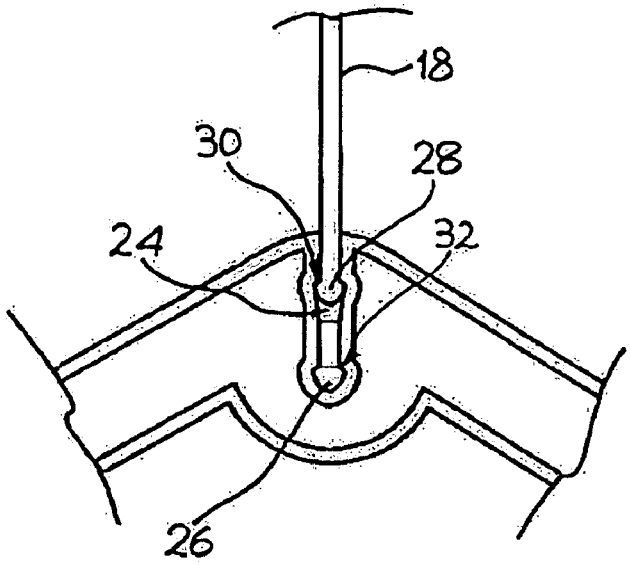
FIGS. 2 and 3 are partial views of the clothes hanger structure of FIG. 1 in two different operating configurations.

As illustrated in FIG. 2, when pressed down, the expansion 28 of the stem 18 slides inside the hole 20 until it locates in the upper toroidal cavity 24, thus defining a first fixing position of the hook in which a large portion of the stem extends above the arms 12,12'. This position determines a maximum distance between the hook 16 and the base of stem 18, and therefore the area where the garment rests on the clothes hanger. This position corresponds to the required configuration of the clothes hanger during manufacture of the garment, as it is suitable for processing of the garment in the production lines.

Figure 3:
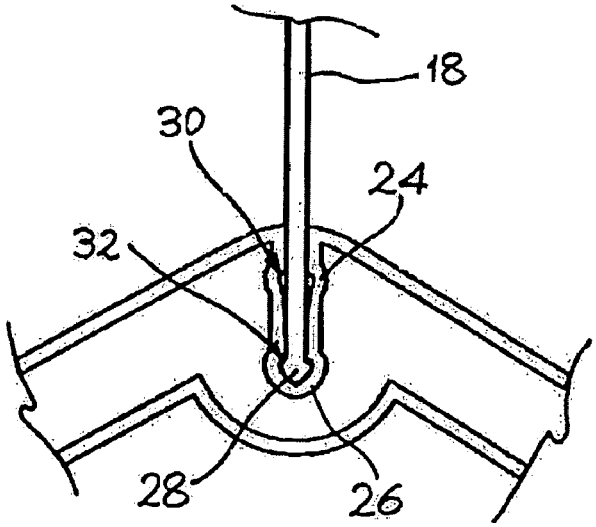

FIG. 3 illustrates the retracted fixing position of the hook, obtained by applying a further downward pressure on the hook. This further pressure disengages the expansion 28 from the upper cavity 24, causes it to slide along the final part of the hole until it locates in the lower toroidal cavity 26. In said second fixing position, the outer stem of the hook is shortened, thus providing the required configuration of the clothes hanger for use in commercial distribution units or by the end user. The stem 18 of the hook is prevented from sliding out of the hole 20, or can slide out only when a considerable force is applied, by the a tooth 30, 32 formed on the upper edge of the toroidal cavities 24, 26, which resists disengagement of the expansion 28 when pulled upwards.

Figure 4:
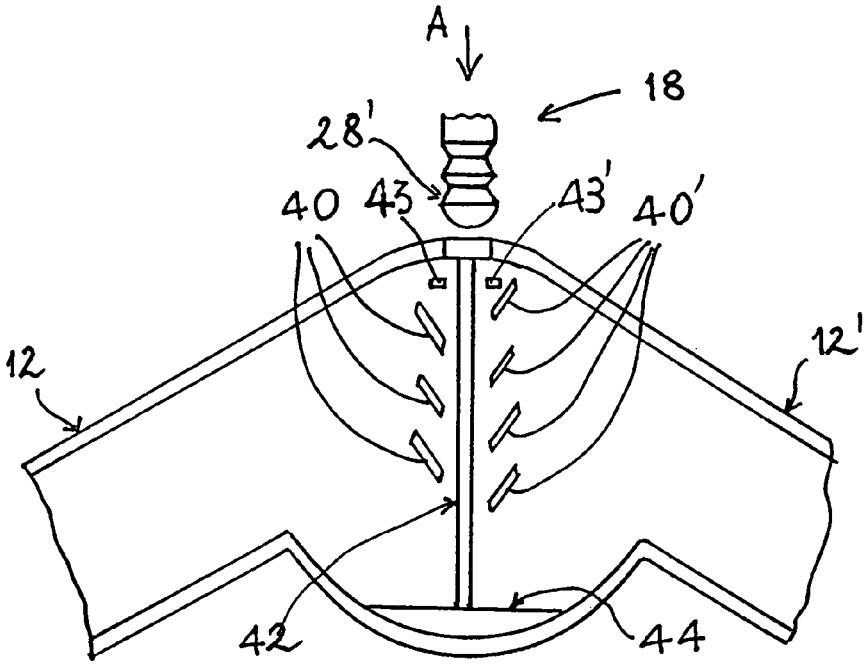
FIG. 4 is an exploded partial view of a half-shell of a clothes hanger structure according to a second embodiment of the invention.
Figure 7:
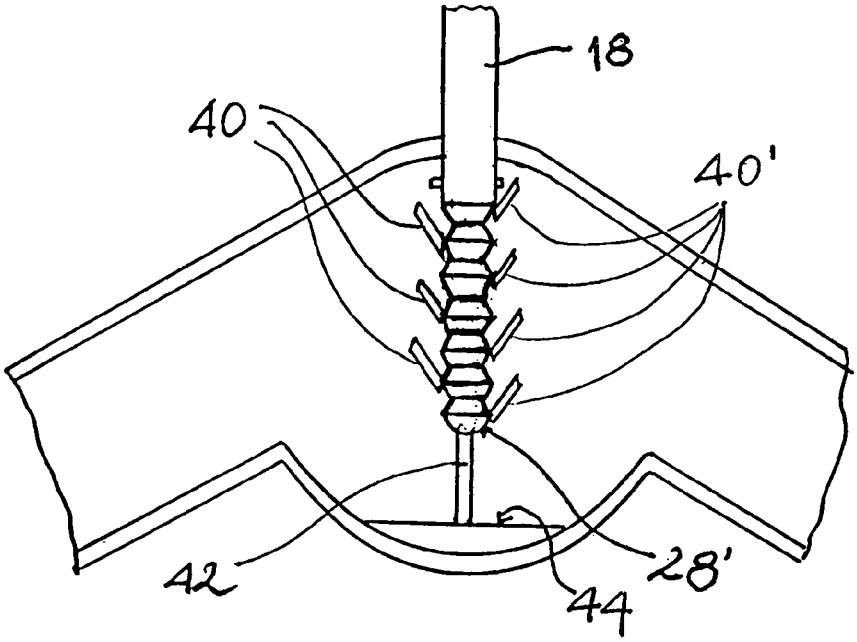
FIG. 7 is a view of the embodiment of FIG. 4 in an operating configuration.

In the embodiment of FIG. 4, the seat for stem 18 is formed by a plurality of slightly flexible first wings 40, 40' provided at the two sides of the centre line 14 of the clothes hanger, at substantially the same distance from said line. First wings 40 and 40' slant downwards and their lower tips are spaced apart from the centre line of a distance slightly less than the diameter of the lower portion 28' of stem 18 of hook 16 (not shown). Preferably, the two rows of first wings 40 and 40' are offset with respect to the centre line. An additional couple of small wings 43, 43', located above wings 40, 40' and oriented perpendicular with respect to the centre line 14, is also provided. Portion 28' of stem 18 is preferably provided with screw threads or expansions, so that by pushing down stem 18 as shown by arrow A, portion 28' is forced to engage wings 43, 43', 40 and 40', and is thereby fixed to the hanger structure. A vertical rib 42 is provided at the centre line of the hanger structure, constituting an additional element of engagement of stem 18, and thereby contributing to fix stem 18 with respect to a vertical movement. A bottom wall 44 provides an abutting end for portion 28' when stem 18 is fully inserted in the hanger structure, namely when the hanging means is in the retracted position of the hanger structure. The extended position of the hanging means of the invention is obtained when stem 18 is inserted between first wings 40, 40' but lower portion 28' does not abut against bottom 44. This configuration is shown in FIG. 7, from which it appears that wings 40, 40' keep stem 18 in a fixed position by acting on the threads of portion 28', which prevent stem 18 from sliding out of the clothes hanger structure, unless a strong pulling force is exerted to disengage portion 28' from wings 40, 40'.

Figure 6:
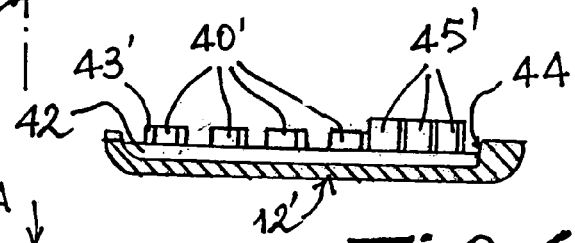
FIG. 6 is a sectional view along line VI–VI of FIG. 5.
Figure 5:
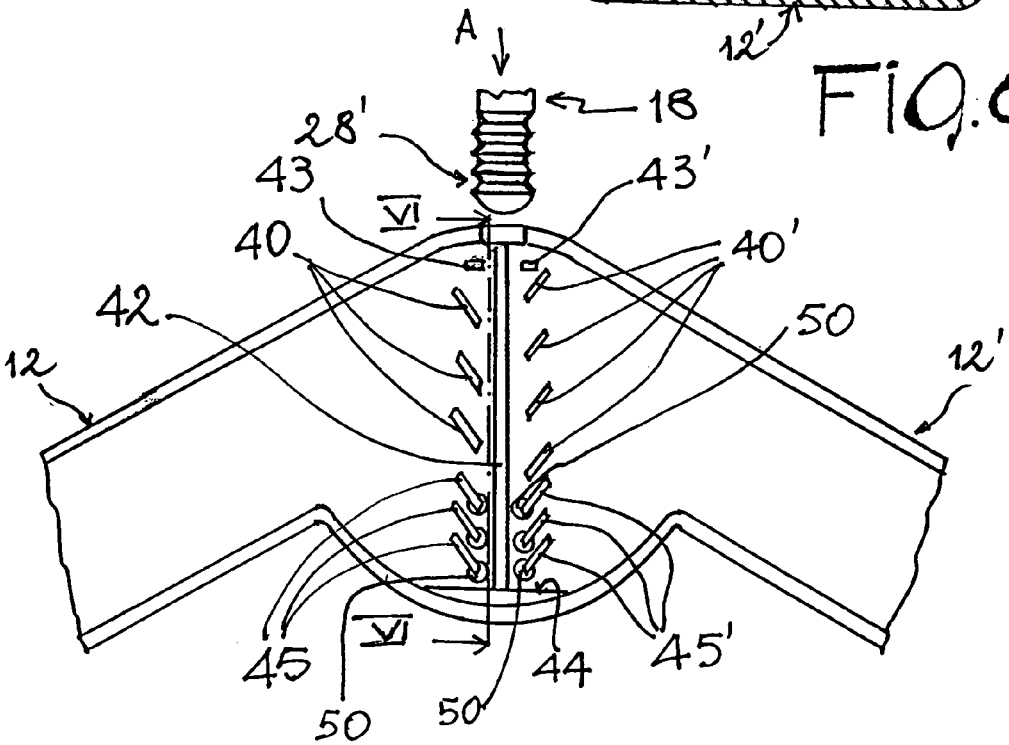
FIG. 5 is an exploded partial view of a half-shell of a clothes hanger structure according to a third embodiment of the invention.

In the embodiment of FIG. 5, the seat for stem 18 is formed by first wings 40, 40', the two small wings 43, 43', and by second wings 45, 45', all provided at the two sides of the centre line 14 of the clothes hanger. Second wings 45, 45' are located below first wings 40, 40' with respect to the direction of arrow A, and are preferably taller than first wings 40, 40', as shown in the sectional view of FIG. 6. To increase the flexibility of second wings 45, 45', holes 50 are provided at the base of second wing 45, 45', preferably below their inner tip. A vertical rib 42 and a bottom wall 44 are also provided, as described in connection to FIG. 4.

Figure 8:
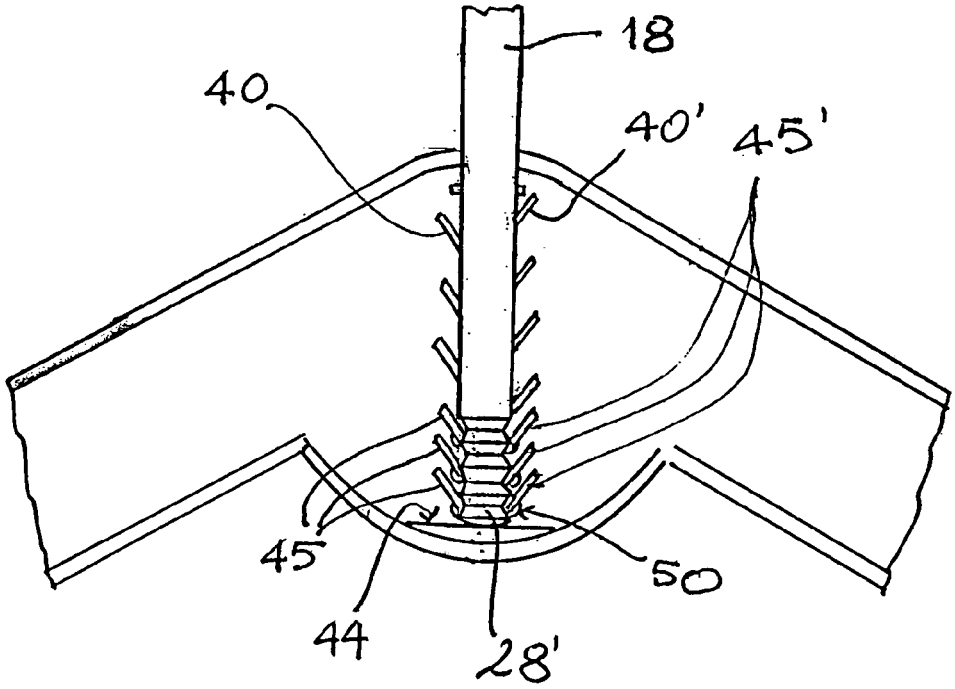
FIG. 8 is a view of the embodiment of FIG. 5 in an operating configuration.

It is understood that FIG. 5, as well as FIGS. 1-4, illustrates a half-shell of a clothes hanger structure according to the invention, the whole hanger being obtained by coupling two corresponding half-shells and fixing them one onto the other by known means. In the embodiment of FIG. 5, whilst first wings 40, 40' are provided in each of the two half-shells forming the clothes hanger, second wings 45, 45' are provided in one half-shell only, thanks to the fact that they are tall enough to exert a sufficient gripping force on stem 18. Holes 50 at the base of wings 45, 45' assist in imparting a desired degree of flexibility to wings 45, 45', despite their bigger size. FIG. 8 shows the retracted configuration of the hanging means in the embodiment of FIG. 5. In such configuration, portion 28' of stem 18 abuts on bottom wall 44 of the clothes hanger, and second wings 45, 45' engage the threads or expansions of portion 28', thus keeping stem 18 fixed and preventing that it slides out of the hanger structure, unless a pulling force sufficient to disengage it is exerted.

It is apparent that the above-described structure can be provided with more than one hanging hook 16, for example two hooks, particularly if the two arms 12, 12' are horizontal and aligned on the same axis. In this case, each hook will be provided with a stem that can be fixed at a variable depth to the structure, as described previously in relation to the embodiments in which the hanging means consists of one single hook. The clothes hanger structure according to the present model is preferably made entirely of plastic or in any case a flexible material. In this case the wall 22 of the hole 20 is made of the same material as the material constituting the rest of the structure. Hook 16 and stem 18 are preferably made of a rigid material, such as metal.

The invention claimed is:

1. A clothes hanger structure comprising:

two arms designed to provide a support for a garment; and a hanging means fixed to said arms, wherein:

said hanging means comprises a stem fixed in a corresponding seat of said structure, said seat being provided with means of engagement of at least a portion of said stem, so that said hanging means can be fixed in at least two positions, one extended and one retracted;

said portion of said stem comprises at least one expansion;

said seat includes an upper toroidal cavity and a lower toroidal cavity that are formed with teeth at their upper edges and engage said at least one expansion.

2. A clothes hanger structure according to claim 1, wherein said seat for said hanging means is provided at the centre line of said hanger structure.

3. A clothes hanger structure according to claim 1, wherein said seat for said hanging means is a hole.

4. A clothes hanger structure according to claim 1, wherein the diameter of said hole is smaller than the maximum transverse dimension of said expansion and at least the wall of said hole is made of a flexible material.

5. A clothes hanger structure according to claim 1, wherein said hanging means comprises at least a hook.

6. A clothes hanger structure comprising:

two arms designed to provide a support for a garment; and a hanging means fixed to said arms, wherein:

said hanging means comprises a stem fixed in a corresponding seat of said structure, said seat being provided with means of engagement of at least a portion of said stem, so that said hanging means can be fixed in at least two positions, one extended and one retracted;

wherein said means of engagement comprises a plurality of wings located at two sides of a centre line of said structure, in a forced contact with at least one portion of said stem.

7. A clothes hanger structure according to claim 6, wherein said wings comprises first wings slanted downwards, having lower tips spaced apart of a distance which is less than the transverse dimension of said portion of said stem.

8. A clothes hanger structure according to claim 7 wherein said first wings are offset with respect to said centre line.

9. A clothes hanger structure according to claim 6, wherein said wings comprise second wings located at the two sides of the centre line of said structure and below said first wings, also said second wings being in a forced contact with at least one portion of said stem.

10. A clothes hanger structure according to claim 9, wherein said second wings are offset with respect to said centre line.

11. A clothes hanger structure according to claim 9, wherein said second wings are of a height greater than the height of said first wings.

12. A clothes hanger structure according to claim 11, wherein holes are provided at the base of said second wings.

13. A clothes hanger structure according to claim 6, wherein said portion of said stem is provided with screw threads.

14. A clothes hanger structure according to claim 6, wherein said means of engagement provided in said seat comprises a rib extending vertically between said plurality of wings.

15. A clothes hanger structure according to claim 6, wherein said means of engagement provided in said seat comprises a bottom wall on which said portion of said stem abuts when said hanging means is in the retracted position.

16. A clothes hanger structure according to claim 6, wherein said hanging means comprises at least a hook.

* * * * *